United States Patent [19]

Noguchi et al.

[11] Patent Number: 4,689,056

[45] Date of Patent: Aug. 25, 1987

[54] AIR CLEANER USING IONIC WIND

[75] Inventors: Hiroki Noguchi, Nishio; Toshiki Kobayashi, Okazaki; Akira Fukami, Okazaki; Tadashi Hattori, Okazaki; Nobuyoshi Sakakibara, Hekinan; Teiichi Nabeta, Okazaki, all of Japan

[73] Assignees: Nippon Soken, Inc., Nishio; Nippondenso Co., Ltd., Kariya, both of Japan

[21] Appl. No.: 902,014

[22] Filed: Aug. 29, 1986

Related U.S. Application Data

[63] Continuation of Ser. No. 673,790, Nov. 21, 1984, abandoned.

[30] Foreign Application Priority Data

Nov. 23, 1983 [JP] Japan ..... 58-220424
Jan. 10, 1984 [JP] Japan ..... 59-3285

[51] Int. Cl.[4] ..... B03C 3/00

[52] U.S. Cl. ..... 55/138; 55/151; 55/152; 55/154

[58] Field of Search ..... 55/136–138, 55/151, 152, 154

[56] References Cited

U.S. PATENT DOCUMENTS

| | | | |
|---|---|---|---|
| 2,789,657 | 4/1957 | Fields | 55/137 |
| 3,816,980 | 6/1974 | Schwab | 55/151 |
| 4,038,583 | 7/1977 | Breton | 361/230 |
| 4,227,894 | 10/1980 | Proynoff | 55/152 |
| 4,231,766 | 11/1980 | Spurgin | 55/138 |
| 4,516,991 | 5/1985 | Kawashima | 55/138 |

FOREIGN PATENT DOCUMENTS

| | | | |
|---|---|---|---|
| 39669 | 11/1981 | European Pat. Off. | 55/138 |
| 2448979 | 4/1976 | Fed. Rep. of Germany | 55/138 |
| 45780 | 11/1977 | Japan | 55/138 |
| 78645 | 6/1981 | Japan | 55/138 |

*Primary Examiner*—Bernard Nozick
*Attorney, Agent, or Firm*—Cushman, Darby & Cushman

[57] ABSTRACT

An air cleaner using an ionic wind having discharge electrodes, a counter electrode arranged downstream of the discharge electrodes, and first and second parallel plate electrodes arranged alternately downstream of the counter electrode. The second parallel plate electrodes are connected to a potential pick-up electrode arranged in the vicinity of the discharge electrodes. The first and second parallel plate electrodes which are arranged alternately serve as dust collecting electrodes.

4 Claims, 10 Drawing Figures

AIR CLEANER USING IONIC WIND

This is a continuation of application Ser. No. 673,790, filed Nov. 21, 1984 which was abandoned upon the filing hereof.

BACKGROUND OF THE INVENTION

1. Field of the Invention

The present invention relates to an air cleaner using an ionic wind.

2. Description of the Prior Art

It is well known in the art that a corona discharge occurs from a discharge electrode such as a needle electrode to a counter electrode such as a plate electrode when a high voltage is applied between the discharge and counter electrodes, and that an ionic wind is then generated.

In this specification, the term "ionic wind" is used to refer to the phenomenon in which air in the vicinity of the discharge electrode is ionized by the corona discharge from the discharge electrode, and ions are moved by an electrostatic force toward the counter electrode. During motion of the ions, a number of neutral molecules are scattered to produce a molecular flow, i.e., a wind. The ionic wind has a velocity of several meters per second, and the force of the wind can be increased or decreased according to the required application of the air cleaner.

When the corona discharge occurs, dust in the air is also ionized, and this ionized dust can be collected on the counter electrode, thereby providing an electrostatic dust collecting function. In this specification, the term "dust" is used to refer mainly to the particulate pollutants such as cigarette smoke.

A plurality of parallel plate electrodes act as a dust collecting electrode member and are arranged at given intervals downstream of the counter electrode. The dust collecting electrode member is arranged in such a manner that the proper electric field is established between every two adjacent electrodes so as to collect dust.

However, a high voltage source is required to generate an ionic wind, and another high voltage source is required for generating the dust collecting electric field. Thus, two high voltage sources are required: one for generating an ionic wind; and the other for collecting the ionized dust. Therefore, in the prior art, an ionic wind type air cleaner which aims at a compact construction has disadvantages in space and cost.

SUMMARY OF THE INVENTION

To solve the above problems, an object of the present invention is to provide an improved, relatively compact air cleaner using an ionic wind, wherein a dust collecting electrode member having a parallel plate structure is arranged downstream of a discharge electrode member, a given potential generated by an electric field of the discharge electrode member is created in other dust collecting electrodes, in such a manner that ionized dust is attracted to and collected on the other dust collecting electrodes and thus a dust collecting power source can be omitted.

According to an embodiment of the present invention, there is provided an air cleaner using an ionic wind comprising: discharge electrodes arranged in an air flow; a counter electrode arranged downstream of the discharge electrodes; first and second parallel plate electrodes arranged alternately downstream of the counter electrode; a potential pick-up electrode arranged in a vicinity of the discharge electrodes and electrically connected to the second parallel plate electrodes; and a high voltage power source connected between the discharge electrodes and the counter electrodes, whereby a dust collecting electric field is established between the alternately arranged first and second parallel plate electrodes.

According to another embodiment of the present invention, there is provided an air cleaner using an ionic wind, comprising: discharge electrodes arranged in an air flow; first parallel plate electrodes having a discharge gap between the discharge electrodes and gaps between every two adjacent plates of the first parallel plate electrodes, an ionic wind passing through these gaps; second parallel plate electrodes electrically insulated from the first parallel plate electrodes and arranged in such a manner that they establish an electric field with the first parallel plate electrodes; and a high voltage source connected between the discharge electrodes and the first parallel plate electrodes, whereby a dust collecting electric field is established between the first parallel plate electrodes and the second parallel plate electrodes.

DESCRIPTION OF THE PREFERRED EMBODIMENTS

Figure 1:
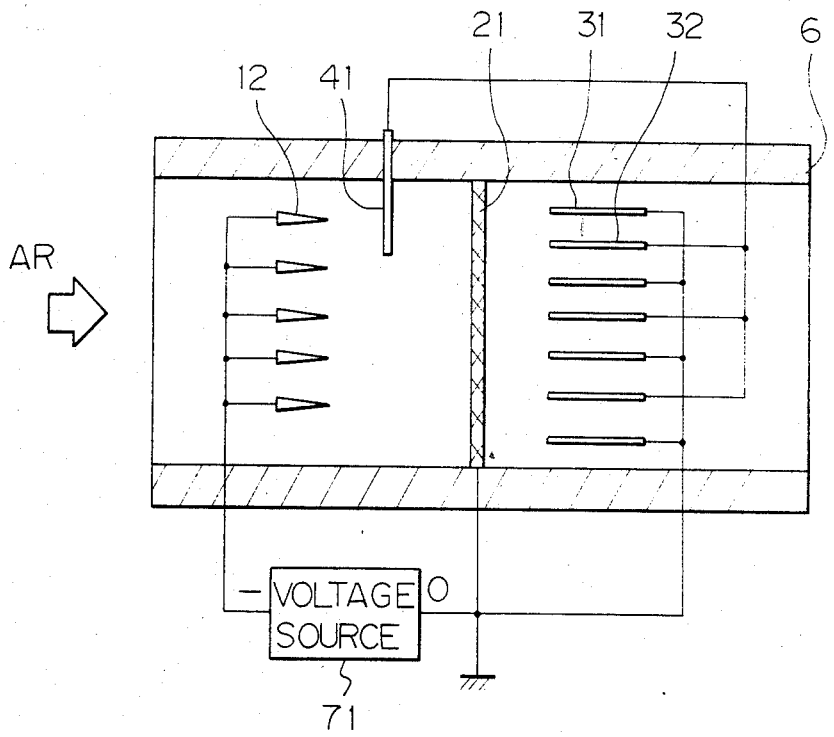
FIG. 1 is a schematic view showing an air cleaner using an ionic wind according to an embodiment of the present invention.

FIG. 1 shows an air cleaner using an ionic wind according to an embodiment of the present invention. Referring to FIG. 1, reference numeral 12 denotes needle electrodes made of tungsten or iron coated with gold or platinum. The tapered ends of the discharge electrodes 12 are pointed downstream of the generation of the ionic wind. The proximal ends of the discharge electrodes 12 are fixed by welding or the like to the surfaces of stainless metal plates 13 (FIG. 2) at equal intervals in such a manner that they are perpendicular to the long sides of the metal plates 13, and so that the length from the distal ends of the discharge electrodes 12 to the metal plates 13 is the same. The metal plates 13 to which the discharge electrodes 12 are welded are parallel to each other, and every two adjacent surfaces of the metal plates 13 are equidistantly arranged in the same manner as the needles. The metal plates 13 are conductively fixed by welding or the like to a metal frame 11. Therefore, the discharge electrodes 12 are uniformly arranged at equal intervals in the metal frame 11, and the discharge electrodes 12, the metal plates 13, and the metal frame 11 constitute a discharge member 1. A negative terminal of a high voltage source 71 is connected to the discharge member 1.

A counter electrode 21 is arranged downstream of the discharge member 1 in such a manner that it is spaced apart from and opposed to the discharge member 1. The counter electrode 21 comprises a metal mesh made of stainless steel or the like, and the air flow passes through the metal mesh. The counter electrode 21 is connected to the positive terminal of the high voltage source 71 and is grounded. A potential pick-up electrode 41 is arranged between the discharge electrodes 12 and the counter electrode 21. The potential pick-up electrode 41 comprises a rod about 1 mm in diameter or a plate and is made of an anticorrosive metal such as chromium-plated iron or brass. The potential pick-up electrode 41 is disposed substantially centrally between the distal end of each discharge electrode 12 and the counter electrode 21 and is fixed by bolts and nuts or an adhesive to a case 6 serving as a case as well as a duct, in such a manner that it will not be moved by the force of the ionic wind or by vibration. The potential pick-up electrode 41 causes second parallel plate electrodes (to be described later) to be charged with a negative potential. A dust collecting electrode member 3 made of a plurality of aluminum plates at predetermined intervals is arranged downstream of the counter electrode 21, in such a manner that it is parallel with the ionic wind. The dust collecting electrode 3 comprises first parallel plate electrodes 31 which are grounded and second parallel plate electrodes 32 electrically connected to the potential pick-up electrode 41. The first and second parallel plate electrodes are alternately arranged at equal intervals, and are fixed to a frame 33 made of ABS resin or the like. The case 6 constitutes a duct surrounding the discharge member 1, the counter electrode 21, and the dust collecting electrode member 3 and is made of an electrically insulating material such as ABS resin. The metal frame 11 of the discharge member 1 and the frame 33 of the counter electrode 21 and the dust collecting electrode member 3 are fixed by bolts or an adhesive to the case 6.

Figure 2:
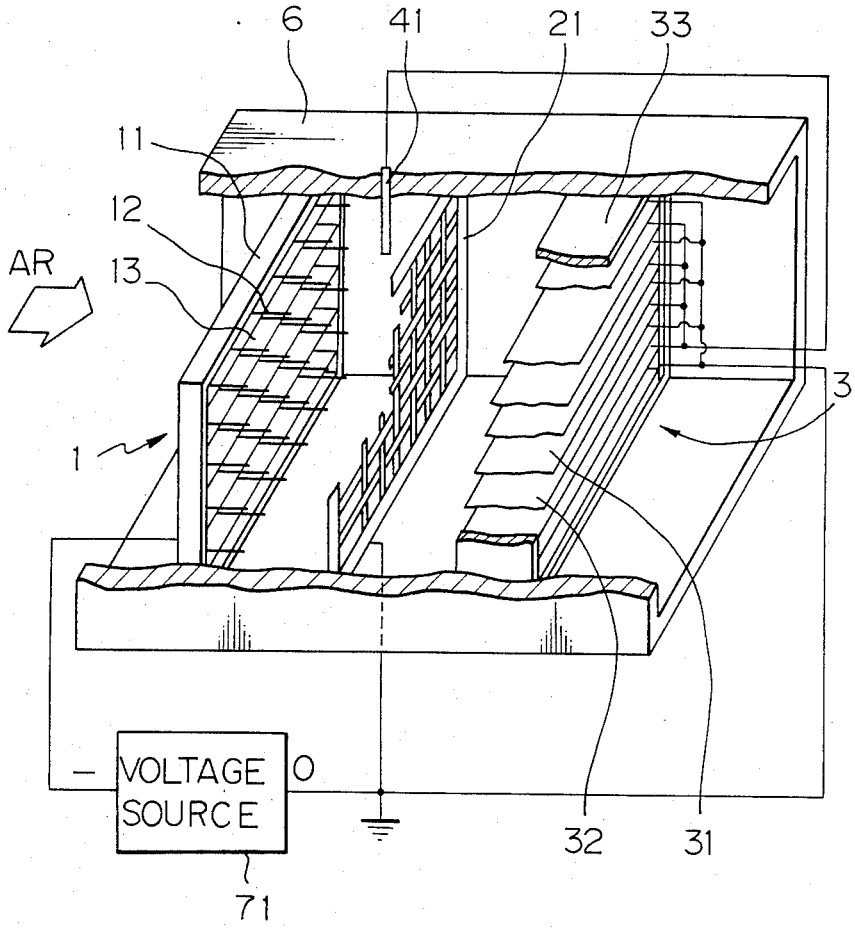
FIG. 2 is a perspective view of the cleaner shown in FIG. 1.

The operation of the air cleaner shown in FIGS. 1 and 2 will now be described.

When a voltage of several kilovolts to several tens of kilovolts is applied by the DC voltage source 71 between the discharge electrodes 12 and the counter electrode 21, a corona is generated at the distal end of each discharge electrode 12, so that a corona discharge occurs between this discharge electrode 12 and the counter electrode 21. The corona is generated at a spatially strong electric field portion, i.e., at the distal end of the discharge electrode 12 when the voltage is applied between the needle electrode and the relatively flat counter electrode 21 and an imbalance occurs between these two electrodes.

The corona discharge produces ions, and the ions are moved from the discharge electrodes 12 to the counter electrode 21 along their lines of electric force. The ions are bombarded against a number of neutral gas molecules, so that air flows from the discharge electrodes 12 to the counter electrode 21. The velocity of the air flow changes in accordance with the distance between two adjacent discharge electrodes 12, the distance between the discharge electrodes 12 and the counter electrode 21, and the voltage applied between the discharge electrodes 12 and the counter electrode 21. When these factors are effectively combined, the air flow may be obtained with a velocity of several meters per second.

The corona discharge between the discharge electrodes 12 and the counter electrode 21 causes the ionic wind and dust to be given a negative charge. A portion of the ionized dust is collected on the counter electrode 21 located downstream of the discharge member 1 and is then further precipitated on the first parallel electrodes 31 of the dust collecting electrode member 3 located downstream of the counter electrode 21. Although the first parallel plate electrodes 31 are grounded, they receive a potential from the potential pick-up electrode 41 which is charged by the electric field of the discharge electrodes 12. The second parallel plate electrodes 32 have the same potential polarity as the discharge member 1. The ionized dust having a negative polarity will become attached not to the second parallel plate electrode 32, but to the first parallel plate electrodes 31.

The potential of the second parallel plate electrodes 32 is determined by the position of the potential pick-up electrode 41. When the potential pick-up electrode 41 is moved close to the discharge electrodes 12, the potential pick-up electrode 41 picks up a higher potential, and when the potential pick-up electrode 41 is moved away from the discharge electrodes 12, the electrode 41 picks up a lower potential. According to the present inventor, when an electric field intensity between the first parallel plate electrodes 31 and the second parallel plate electrodes 32 falls within the range between 0.5 kV/mm to 1 kV/mm, a satisfactory dust collection efficiency can be obtained. Therefore, the distance between the first and second parallel plate electrodes 31 and 32 and the position of the potential pick-up electrode 41 are determined in such a manner that the above-mentioned electric field intensity will be obtained.

Figure 3:
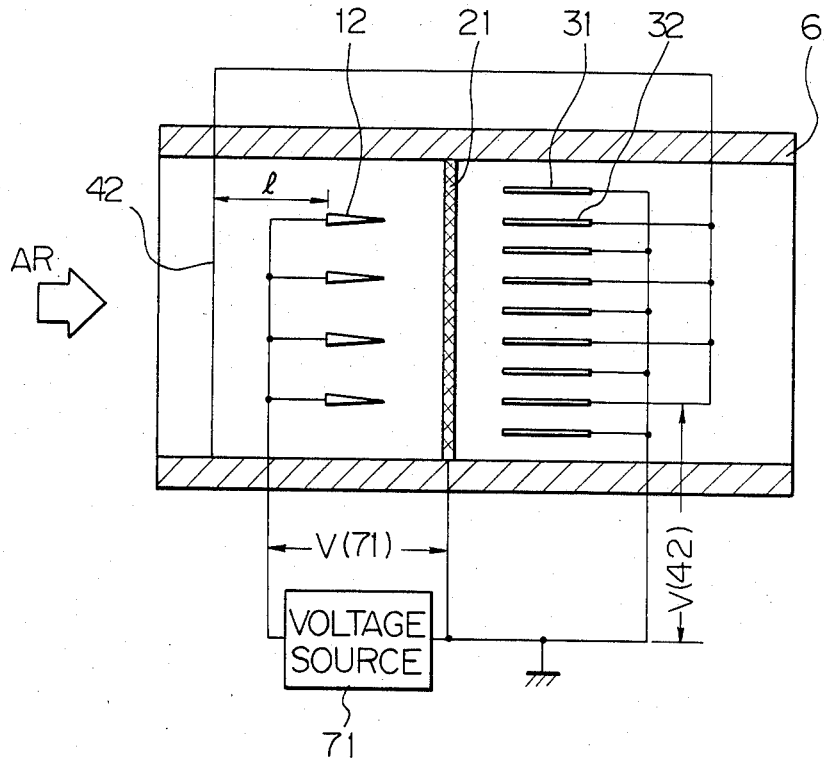
FIG. 3 is a schematic view showing another embodiment of the air cleaner according to the present invention.

FIG. 3 is a cross-sectional view of an air cleaner according to another embodiment of the present invention. In the air cleaner shown in FIG. 3, a potential pick-up electrode 42 is arranged upstream of the needle discharge electrodes 12. The potential pick-up electrode 42 comprises a metal wire about 0.1 mm in diameter made of an anticorrosive metal such as tungsten or the like. This wire is stretched without sag upstream of and spaced by a distance l from the discharge electrodes 12. The wire is fixed by an adhesive to the case 6.

Figure 4:
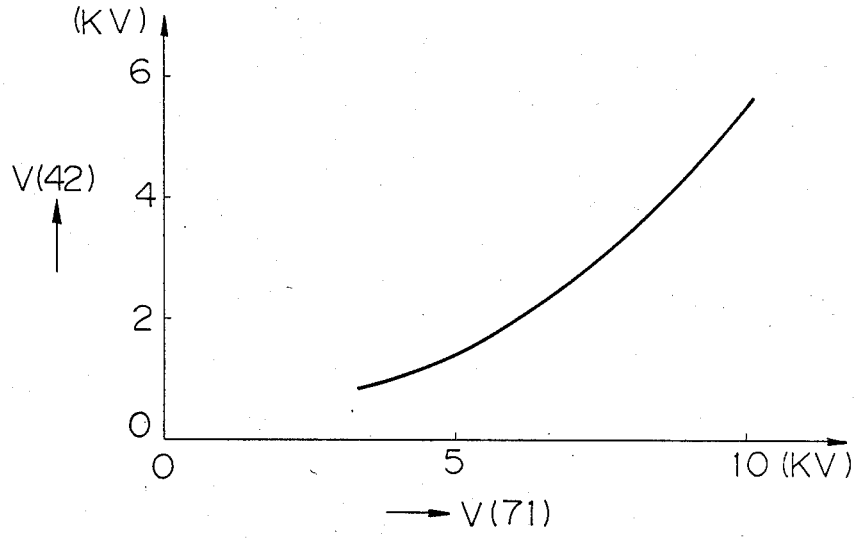
FIG. 4 is a graph showing voltage characteristics of the cleaner shown in FIG. 3.

Assuming that a voltage applied by the high voltage source 71 between the discharge electrodes 12 and the counter electrode 21 is given as V(71), that a voltage appearing at the potential pick-up electrode 42 is given as V(42), that the distance l between the potential pick-up electrode 42 and the discharge electrodes 12 is given as 0.5 mm, and that the potential pick-up electrode 42 comprises a wire having a diameter of 160 μm, then the voltages V(71) and V(42) will have the relationship illustrated in FIG. 4. When the voltage V(71) applied between the discharge electrodes 12 and the counter electrode 21 increases, the voltage V(42) appearing at the potential pick-up electrode 42 also increases. If a potential is picked up from the potential pick-up electrode 42 a sufficiently high dust collection efficiency is ensured by decreasing the gap between the adjacent first and second parallel plate electrodes 31 and 32 and increasing the number of first and second parallel plate electrodes 31 and 32, thereby increasing the total dust collecting area, even if the potential pick-up electrode 42 is located at a greater distance from the discharge electrodes 12.

If dense smoke enters between the first and second parallel electrodes 31 and 32, a dielectric constant between the adjacent first and second parallel plate electrodes 31 and 32 is increased, so that a substantially constant charge is supplied from the potential pick-up electrode 42 to the second parallel plate electrodes 32, and the electric field intensity between the corresponding first and second parallel plate electrodes 31 and 32 is increased. As a result, the dust collection efficiency will remain high even if the ionized dust becomes attached to the first parallel plate electrodes 31.

Figure 5:
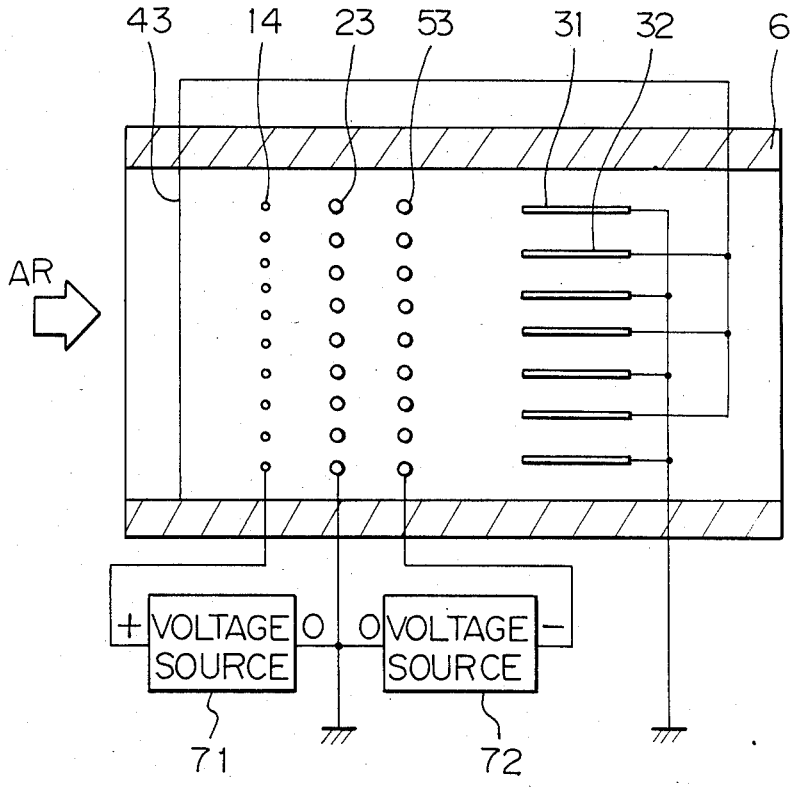
FIG. 5 is a schematic view showing still another embodiment of the air cleaner according to the present invention.
Figure 6:
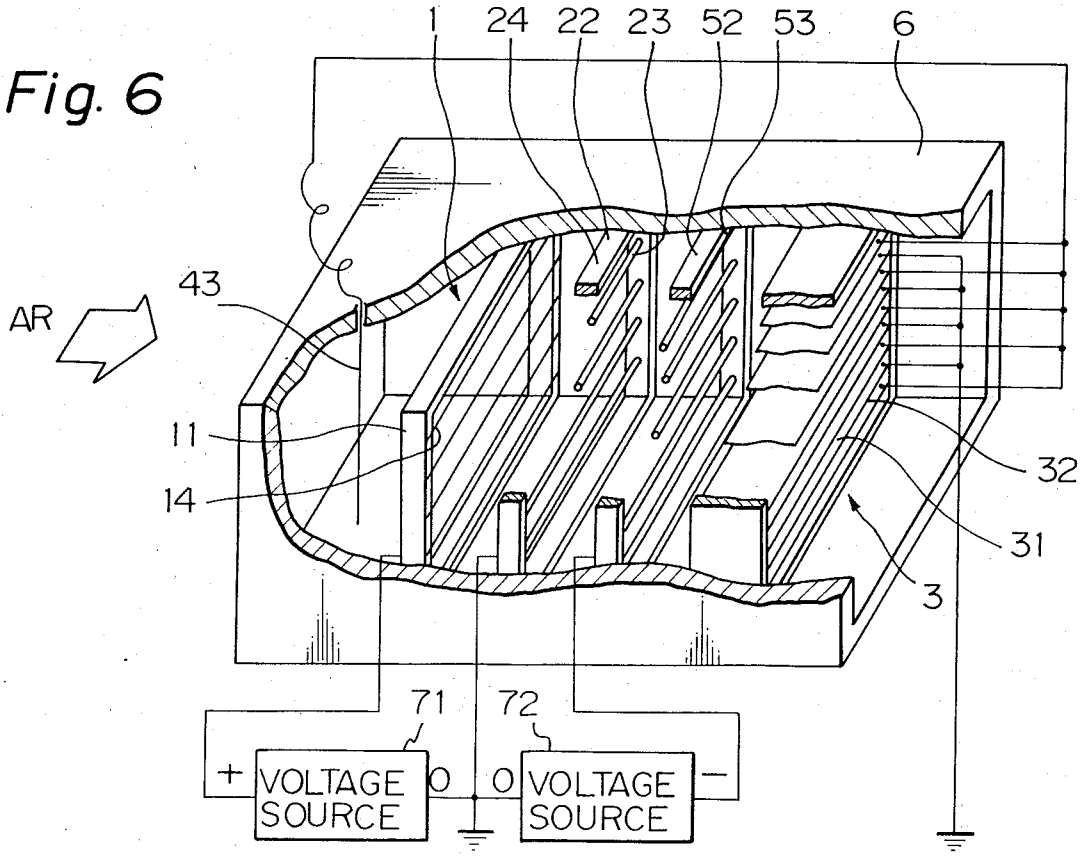
FIG. 6 is a perspective view of the cleaner shown in FIG. 5.

Another embodiment of the air cleaner according to the present invention is illustrated in FIGS. 5 and 6, wherein the influence of ozone ($O_3$) generated by the ionic wind is taken into consideration.

In the air cleaner shown in FIGS. 5 and 6, the discharge member 1 is arranged in such a manner that wires about 20 to 60 μm in diameter and made of tungsten or platinum are fixed by welding or the like to a stainless rectangular frame 11 and are spaced at predetermined intervals. These wires constitute the discharge electrodes 14. In this case, the wires are stretched taut and in parallel, and are aligned on a plane corresponding to one end face of the frame 11. The wires are arranged in the insulating case 6 in such a manner that the plane of alignment is directed toward a counter electrode 22 and are fixed in the case 6 by bolts and nuts or an adhesive. The case 6 is made of ABS resin or the like. The counter electrode 22 is arranged in such a manner that round rods 23 about 0.1 to 0.5 mm in diameter and made of stainless steel or the like are fixed, by welding or the like, in a stainless steel frame 24 or the like, in parallel and at predetermined intervals.

The counter electrode 22 is fixed in the case 6 by bolts and nuts or an adhesive and spaced by a predetermined distance from the discharge member 1. Reference numeral 53 denotes an acceleration electrode having the same construction as the counter electrode 22 and spaced by a predetermined distance from the counter electrode 22. The dust collecting electrode member 3 and a potential pick-up electrode 43 are the same as those shown in FIG. 3. Reference numerals 71 and 72 denote high voltage sources. The positive terminal of the high voltage source 71 is connected to the frame 11, and the negative terminal is grounded. The negative terminal of the high voltage source 72 is connected to the frame of the acceleration electrode 53, and the positive terminal is grounded. The frame 24 of the opposing electrode 22 is grounded. The dust collecting electrode member 3 and the potential pick-up electrode 43 are the same as those shown in FIG. 3.

The operation of the air cleaner shown in FIGS. 5 and 6 will now be described. A voltage of several tens of kilovolts is applied by the high voltage source 71 between the discharge member 1 and the counter electrode 22. The ionic wind is then generated in the same manner as shown in FIGS. 1 and 3. In addition, the discharge electrodes 14 are set at a positive polarity to ionize the dust, and the positively ionized dust is accelerated by an acceleration electrode 53 set at a negative potential. Thus, the voltage at the discharge electrodes 14 is kept low, and the generation of ozone ($O_3$) decreased. The ionized dust is attracted to and collected onto the first parallel plate electrodes 31.

Figure 7:
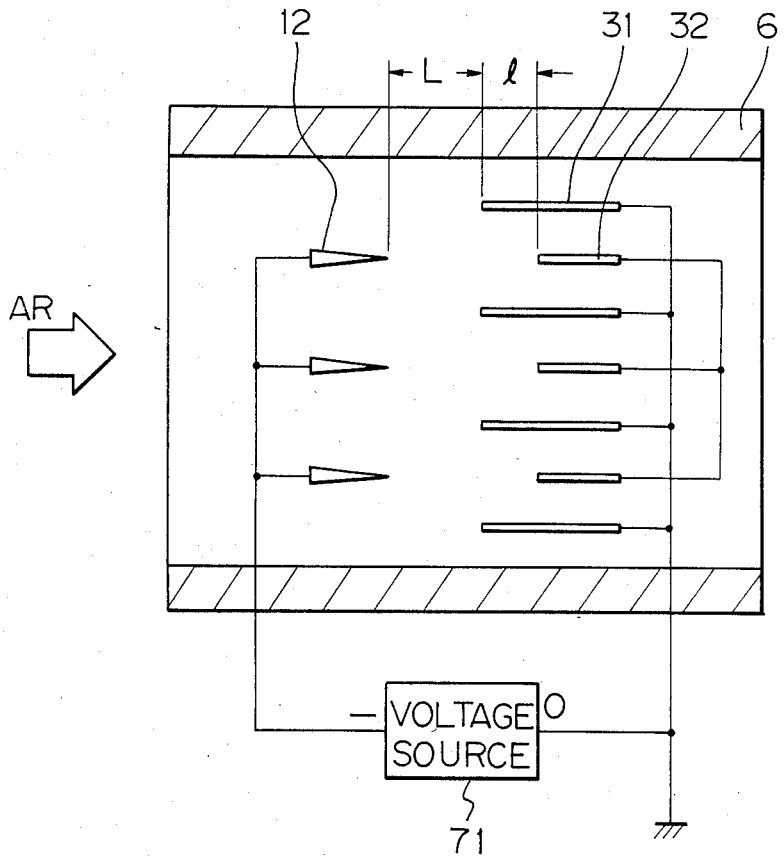
FIG. 7 is a schematic view of an air cleaner using an ionic wind according to yet another embodiment of the present invention.
Figure 8:
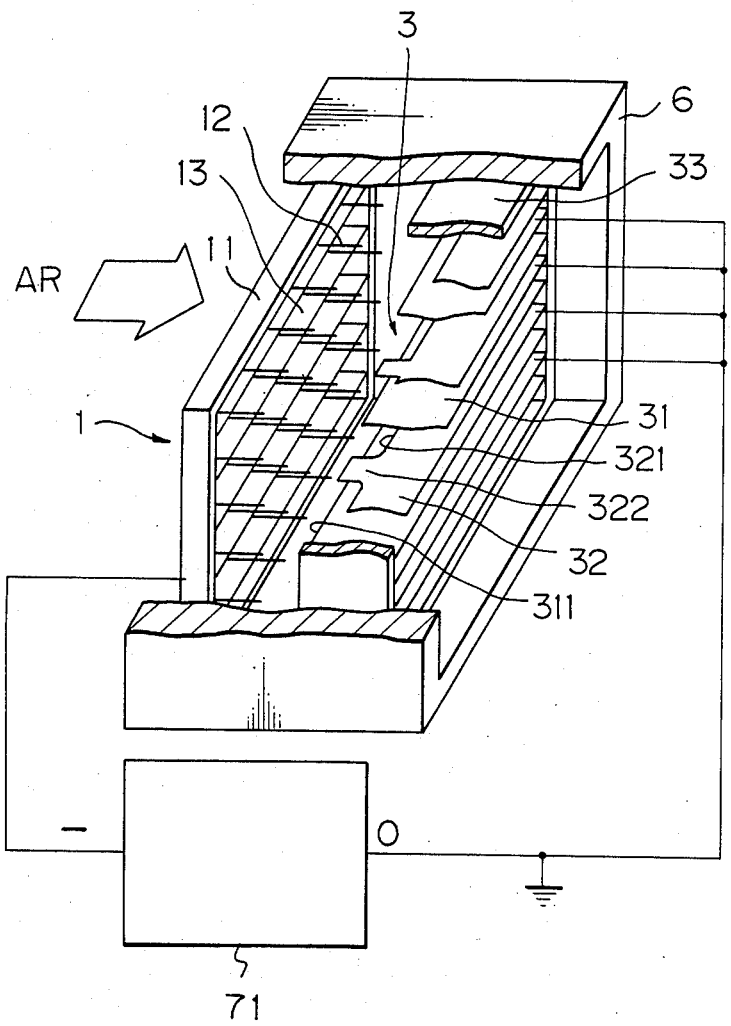
FIG. 8 is a perspective view of the cleaner shown in FIG. 7.

FIG. 7 shows an air cleaner using an ionized air flow according to another embodiment of the present invention, and FIG. 8 is a perspective view thereof. Discharge electrodes 12, metal plates 13, and a metal frame 11 constitute a discharge member 1. A plurality of counter electrodes 31 made of a conductive material such as aluminum are disposed to oppose the discharge member 1 in such a manner that the distal ends of the discharge electrodes 12 are spaced by a predetermined distance from the corresponding counter electrodes 31. The counter electrodes 31 are parallel to the ionic wind, and are adhered to mounting grooves in an insulating frame 33 made of ABS resin.

Each electric field generating electrode 32 made of a conductive material such as aluminum is arranged between every two adjacent counter electrodes 31 and is fixed by an adhesive in a mounting groove in the frame 33.

The end portions 311 of each counter electrode 31, which are opposite to the corresponding discharge electrode 12, are spaced by a predetermined distance from the discharge electrode 12, thereby obtaining a stable discharge.

An end portion 321 of the electric field generating electrode 32, which is opposite to the distal end of the corresponding discharge electrode 12, is located downstream of the end portion 311 along the direction of the ionic wind. Several projections 322 are formed at part of the end portion 321 of each electric field generating electrode 32, and the distal end of each projection 322 is formed at a position corresponding to the end portion 311 of the counter electrode 31.

As is apparent from the description, the counter electrodes 31 and the electric field generating electrodes 32 are mounted in the frame 33, thereby constituting a dust collecting member 3.

Reference numeral 71 denotes a high voltage source. The negative terminal of the high voltage source 71 is connected to the metal frame 11 of the discharge member 1, and the positive terminal is grounded and is connected to the opposing electrodes 31 of the dust collecting member 3.

The discharge member 1 and the dust collecting member 3 are fixed by stays (not shown) or the like in a case 6 made of an insulating material such as ABS resin.

The operation of the air cleaner shown in FIGS. 7 and 8 will now be described.

A voltage of several kilovolts to several tens of kilovolts is applied by the voltage source 71 between the discharge electrodes 12 and the counter electrodes 31, and a corona is generated at the distal end of each discharge electrode 12 set at a negative potential, in such a manner that a corona discharge is generated toward the corresponding counter electrode 31. The corona is generated at the spatially strong electric field portion, i.e., the distal end of the discharge electrode 12, when the voltage is applied between the discharge electrode 12 and the plate electrodes 31 and 32, and an imbalance occurs between these electrodes. The corona discharge produces ions, and the ions are moved from the discharge electrodes 12 to the counter electrode 31 along the electric lines of force. The ions are bombarded against a number of neutral gas molecules, so that air flows from the discharge electrodes 12 to the counter electrode 31 as indicated by an arrow AR. The velocity of the air flow changes in accordance with the distance between the two adjacent discharge electrodes 12, the distance between the discharge electrode 12 and the counter electrode 31, or the voltage applied between the discharge electrode 12 and the counter electrode 31. When these factors are properly combined, the air flow may reach a velocity of several meters per second. When an air flow having a velocity of several meters per second is obtained, and the ventilation area of the counter electrodes 31 is the same as the dust collecting opening area of a vehicle air cleaner using a motor and a fan, the same quantity of air flow as in the air cleaner using the motor and the fan can be obtained.

The corona discharge between the electrodes produces the ionic wind and ionized dust in the air, and the ionized dust is collected on the electrodes 31.

The electrodes 32 are set at the same polarity as the discharge electrodes 12 by means of the potential pick-up projection 322. That is, the electrodes 32 are set at the negative potential. An electric field is generated between the electrodes 31 and 32 in a direction perpendicular to the ionic wind. Therefore, the dust charged by the ionic wind at the negative polarity is attracted toward the electrodes 31 by an electric field formed by the electrodes 31 and 32 when the ionized dust passes therebetween. As a result, the dust can be effectively collected onto the electrodes 31.

Results of a test made by the present inventors concerning a distance l (hereinafter referred to as a charge distance) between the end portion 321 of the electrode 32, which is opposite to the discharge electrode 12, and the end portion 311 of the counter electrode 31 will now be described.

It is assumed that the electrode 32 does not have a projection 322.

The test was made to measure changes in air velocity P and a voltage V(32) of the electrode 32 when the charge distance l changes. The voltage V(71) of the high voltage source 71 was 9 kV, and the discharge interval L between the discharge electrode 12 and the electrode 31 was 10 mm.

Figure 9:
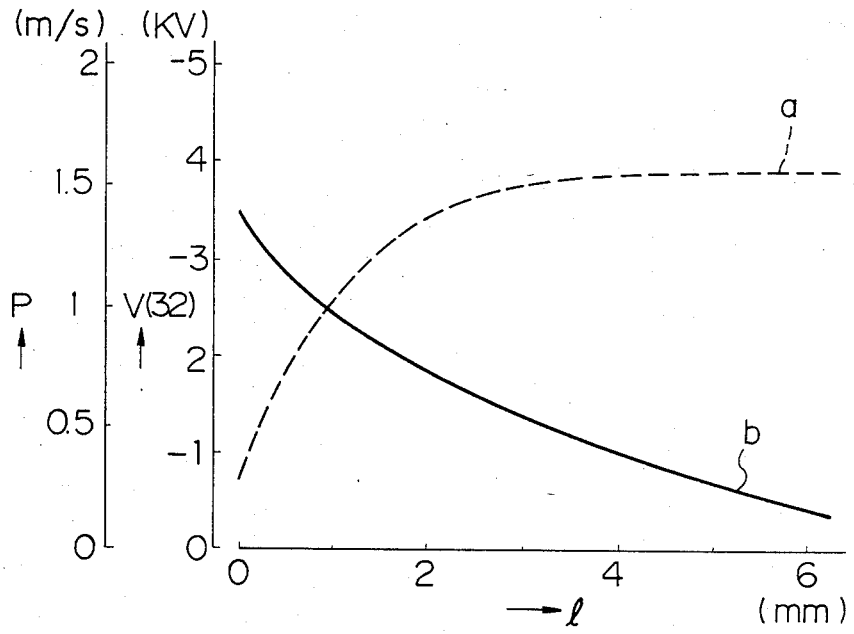
FIG. 9 is a graph showing the operation characteristics of the cleaner shown in FIG. 7.

FIG. 9 is a graph showing the results of the test. The charge distance l is plotted along the abscissa, and the air velocity P and the voltage V(32) of the electrode 32 are plotted along the ordinate.

As shown in FIG. 9, the shorter the charge distance l, i.e., when the electrode 32 moves closer to the corresponding discharge electrode 12, the higher the intermediate potential. However, when the charge distance l is larger, i.e., when the electrode 32 moves away from the corresponding discharge electrode 12, the voltage V(32) becomes low. To obtain a higher dust collection efficiency, the electric field intensity must become strong, i.e., the voltage V(32) must be high. Therefore, to improve the dust collection efficiency, the electrode 32 must move closer to the corresponding discharge electrode 12.

When the electrode 32 moves closer to the corresponding discharge electrode 12, the velocity of the ionic wind generated in accordance with the principle described above is decreased. In particular, when the charge distance l is less than 2 mm, the velocity P is abruptly decreased. This is because ions to be moved by the corona discharge toward the electrodes 31 are subjected to repulsion and interrupt the ionized air flow, since the electrode 32 has the same polarity as that of the corresponding discharge electrode 12. Therefore, to obtain a sufficient velocity, the charge distance l in FIG. 9 must be more than 2 mm. However, under this condition, a sufficient voltage V(32) at the electrode 32 cannot be obtained. To solve this problem, the projection 322 shown in FIG. 8 is formed as a part of each electrode 32, thereby obtaining a high intermediate potential. In addition, when the projection 322 is so small that the ionic wind is prevented, a sufficient air velocity and high dust collection efficiency can be obtained.

A comparison is made between the case wherein the projection 322 is formed and that wherein the projection 322 is not formed. The following was confirmed. The conditions given were such that $P=1$ m/s and the voltage $V(32)=2.5$ kV for $l=1$. However, if the projection 322 is located at a position where $l=0$, and the end portion 321 of the electrode 32 is located at a position where $l=3$ mm, the velocity $P=1.5$ m/s, and the voltage $V(32)\approx 3.5$ kV were obtained. Thus, the air velocity is increased and dust collection efficiency is improved.

Figure 10:
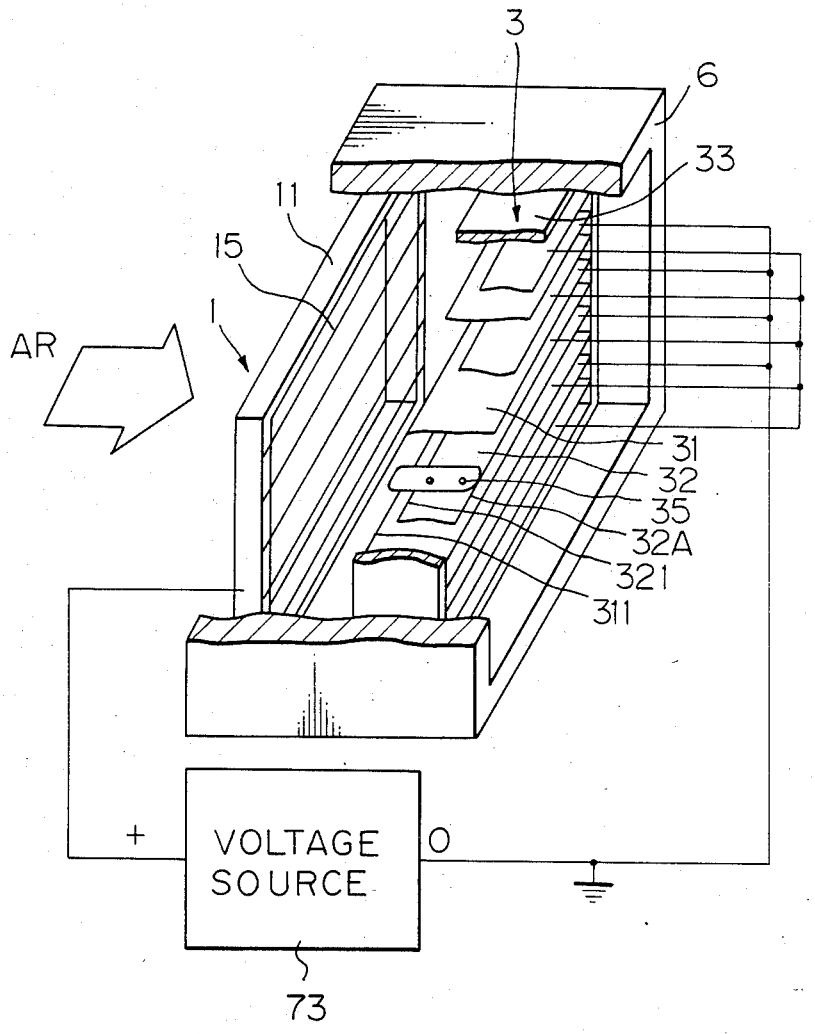
FIG. 10 is a schematic view showing a further embodiment of the air cleaner according to the present invention.

FIG. 10 shows another embodiment of an air cleaner according to the present invention. Linear discharge electrodes 15 are arranged in the frame 11 in the discharge member 1 and comprise wires 20 to 60 μm in diameter and made of tungsten or platinum.

The end portion 321 of each of the electric field generating electrodes 32 is located 3 mm below the end portion 311 of the corresponding counter electrode 31. A potential pick-up electrode 35 for picking up a potential from the discharge electrode 15 is fixed by screws or the like at one portion 32A of the electric field generating electrodes 32. A distal end 23 of the electrode 35 is located at a position corresponding to the end portion 311 of the corresponding counter electrode 31. The electric field generating electrode 32A, to which the electrode 35 is fixed, is connected by lead wires to the remaining electric field generating electrodes 32 to be kept at the same potential.

In the air cleaner shown in FIG. 10, the positive terminal of a high voltage source 73 is connected to the metal frame 11 of the discharge member 1, and the negative terminal is grounded and connected to the counter electrodes 31. Thus, compared with the air cleaner shown in FIGS. 7 and 8, corona discharge is performed at a relatively low voltage, and the amount of ozone decreased.

In another embodiment of the present invention, a power source different from the high voltage source may be also connected to the metal frame 11 of the discharge member 1, to flow a current through the discharge electrodes 15 to generate heat. This heat may be effectively used to eliminate ozone generated in the vicinity of the discharge electrodes 15.

As another embodiment of the invention, the frame 33 of the dust collecting member 3 may be made of a conductive metal, and the counter electrodes 31 mounted in the metal frame 33. A plastic frame which is smaller than the metal frame and has recesses corresponding to the counter electrodes may be arranged inside the metal frame. The electric field generating electrodes 32 and the counter electrodes 31 may be alternately arranged in this plastic frame. In this case, the ground terminal of the high voltage source can be connected to the metal frame 33.

As another embodiment, the frame 33 of the dust collecting member 3 may be made of a metal and only the counter electrodes 31 arranged in this frame 33. Another metal frame holding only the electric field generating electrodes 32 is added downstream of the frame 33. In addition, the distal ends of the electric field generating electrodes 32 may be extended to form an electric field with the counter electrodes 31.

In the above embodiments, the counter electrodes 31 and the electric field generating electrodes 32 are not limited to plate electrodes, but can be corrugated electrodes or concentric electrodes.

We claim:

1. An air cleaner of the ionic wind type comprising:
discharge electrodes of the needle or wire type arranged in a duct for generating corona discharge;
a counter electrode arranged downstream of said discharge electrodes;
a dust collecting electrode portion having first plate electrodes and second plate electrodes alternately arranged downstream of said counter electrode, a high voltage being supplied from a power source to said discharge electrodes to generate an ionic wind in the direction from said discharge electrodes to said counter electrode to cause said generated ionic wind to be led to said dust collecting electrode, whereby a separation of dust from the air passing through said duct takes place; and
an electric potential pick-up electrode being arranged in a vicinity of said discharge electrodes and being elctrically connected to said second plate electrodes of said dust collecting electrode portion, said first plate electrodes of said dust collecting electrode portion being grounded, an electric field being generated between said first plate electrodes and said second plate electrodes of said dust collecting electrode portion by supplying the potential of said electric potential pick-up electrode established by the electric field from said discharge electrodes, and dust in the air passing through said duct being collected on said first plate electrodes of said dust collecting electrode portion.

2. An air cleaner according to claim 1, wherein said potential pick-up electrode is arranged between said discharge electrodes and said counter electrode.

3. An air cleaner according to claim 1, wherein said potential pick-up electrode is arranged upstream of said discharge electrodes.

4. An air cleaner according to claim 1, further comprising an acceleration electrode arranged downstream of said counter electrode.

* * * * *